US006817613B2

(12) United States Patent
Hasek

(10) Patent No.: US 6,817,613 B2
(45) Date of Patent: Nov. 16, 2004

(54) SYSTEM AND METHOD FOR TEACHING PROJECT MANAGEMENT SKILLS

(75) Inventor: Peter A. Hasek, Commerce Township, Oakland County, MI (US)

(73) Assignee: Electronic Data Systems Corporation, Plano, TX (US)

( * ) Notice: Subject to any disclaimer, the term of this patent is extended or adjusted under 35 U.S.C. 154(b) by 0 days.

(21) Appl. No.: 10/105,505

(22) Filed: Mar. 20, 2002

(65) Prior Publication Data

US 2003/0178769 A1 Sep. 25, 2003

(51) Int. Cl.[7] ..... A63F 3/00
(52) U.S. Cl. ..... 273/256; 273/278; 434/128
(58) Field of Search ..... 273/236, 243, 273/248, 242, 249, 256; 434/128

(56) References Cited

U.S. PATENT DOCUMENTS 3,850,433 A * 11/1974 Purlia ..... 273/142 E
4,130,284 A * 12/1978 Fuks ..... 273/248
4,416,454 A * 11/1983 Delamontagne ..... 273/243
6,237,915 B1 * 5/2001 Ledet et al. ..... 273/236

* cited by examiner

*Primary Examiner*—Vishu K. Mendiratta
(74) *Attorney, Agent, or Firm*—Baker Botts L.L.P.

(57) ABSTRACT

A project management game is provided that includes a game board having indicia thereon representing a plurality of tasks that collectively form a plurality of deliverables to be completed and to be managed by a plurality of participants in the game. The participants form one or more teams that play the game. A plurality of game pieces are positioned on the game board. Each game piece represents a selected one of the teams. The game further includes a first die having a plurality of sides with numbers thereon. The first die may be rolled in order to indicate a number of spaces to be moved by a selected one of the game pieces. A second die is also included having a plurality of sides with numbers thereon. The second die may be rolled in order to indicate a cost value associated with one or more of the tasks.

13 Claims, 9 Drawing Sheets

| | | SUN | | | | | | | | | | | | | | | |
|---|---|---|---|---|---|---|---|---|---|---|---|---|---|---|---|---|---|
| | | 1 | | | | 2 | | | | 3 | | | | 4 | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 |
| | RED | | | | | | | | | | | | | | | | |
| ACME | GREEN | | | | | | | | | | | | | | | | |
| eDOT | BLUE | | | | | | | | | | | | | | | | |
| COMPANY | AQUA | | | | | | | | | | | | | | | | |
| | MAGENTA | | | | | | | | | | | | | | | | |
| | ORANGE | | | | | | | | | | | | | | | | |
| | | STAR | | | | | | | | | | | | | | | |
| | | 1 | | | | 2 | | | | 3 | | | | 4 | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 |
| | RED | | | | | | | | | | | | | | | | |
| ACME | GREEN | | | | | | | | | | | | | | | | |
| eDOT | BLUE | | | | | | | | | | | | | | | | |
| COMPANY | AQUA | | | | | | | | | | | | | | | | |
| | MAGENTA | | | | | | | | | | | | | | | | |
| | ORANGE | | | | | | | | | | | | | | | | |

TO FIG. 3B

FROM FIG. 3A

| | | TRIANGLE | | | | | | | | | | | | | | | |
|---|---|---|---|---|---|---|---|---|---|---|---|---|---|---|---|---|---|
| | | 1 | | | | 2 | | | | 3 | | | | 4 | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 |
| | RED | | | | | | | | | | | | | | | | |
| ACME | GREEN | | | | | | | | | | | | | | | | |
| eDOT | BLUE | | | | | | | | | | | | | | | | |
| COMPANY | AQUA | | | | | | | | | | | | | | | | |
| | MAGENTA | | | | | | | | | | | | | | | | |
| | ORANGE | | | | | | | | | | | | | | | | |
| | | CROSS | | | | | | | | | | | | | | | |
| | | 1 | | | | 2 | | | | 3 | | | | 4 | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 |
| | RED | | | | | | | | | | | | | | | | |
| ACME | GREEN | | | | | | | | | | | | | | | | |
| eDOT | BLUE | | | | | | | | | | | | | | | | |
| COMPANY | AQUA | | | | | | | | | | | | | | | | |
| | MAGENTA | | | | | | | | | | | | | | | | |
| | ORANGE | | | | | | | | | | | | | | | | |
| | | DIAMOND | | | | | | | | | | | | | | | |
| | | 1 | | | | 2 | | | | 3 | | | | 4 | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 |
| | RED | | | | | | | | | | | | | | | | |
| ACME | GREEN | | | | | | | | | | | | | | | | |
| eDOT | BLUE | | | | | | | | | | | | | | | | |
| COMPANY | AQUA | | | | | | | | | | | | | | | | |
| | MAGENTA | | | | | | | | | | | | | | | | |
| | ORANGE | | | | | | | | | | | | | | | | |

*FIG. 3B*

| CURRENT STATUS | | | | | | | | | | |
|---|---|---|---|---|---|---|---|---|---|---|
| | WEEK 1 | WEEK 2 | WEEK 3 | WEEK 4 | WEEK 5 | WEEK 6 | WEEK 7 | WEEK 8 | | |
| BCWP | | | | | | | | | | |
| BCWP(cum) | | | | | | | | | | |
| ACWP | | | | | | | | | | |
| ACWP(cum) | | | | | | | | | | |
| BCWS | 1200 | 1200 | 1200 | 1200 | 1200 | 1200 | 0 | 0 | | |
| BCWS(cum) | 1200 | 2400 | 3600 | 4800 | 6000 | 7200 | 7200 | 7200 | | |
| %COMPLETE | | | | | | | | | BCWP/BAC | |
| CV | | | | | | | | | BCWP−ACWP | |
| SV | | | | | | | | | BCWP−BCWS | |
| CPI | | | | | | | | | BCWP/ACWP | |
| SPI | | | | | | | | | BCWP/BCWS | |
| | | | | | | | | | | |
| FORECAST | | | | | | | | | | |
| | WEEK 1 | WEEK 2 | WEEK 3 | WEEK 4 | WEEK 5 | WEEK 6 | WEEK 7 | WEEK 8 | | |
| ETC | | | | | | | | | (BAC−BCWP)/CPI | |
| BAC | 7200 | 7200 | 7200 | 7200 | 7200 | 7200 | 7200 | 7200 | | |
| EAC | | | | | | | | | BCWS+ETC | |
| VAC | | | | | | | | | BAC−EAC | |
| | | | | | | | | | | |
| | | | | | | | | | | |
| RISK MANAGEMENT RESERVE | | | | | | | | | | |
| | WEEK 1 | WEEK 2 | WEEK 3 | WEEK 4 | WEEK 5 | WEEK 6 | WEEK 7 | WEEK 8 | | |
| RMR | | | | | | | | | | |
| NET RMR | | | | | | | | | VAC−RMR | |
| | | | | | | | | | | |

*FIG. 4*

| CURRENT STATUS | | | | | | | | |
|---|---|---|---|---|---|---|---|---|
| | WEEK 1 | WEEK 2 | | | | | | |
| BCWP | | | BUDGETED COST OF THE WORK PERFORMED | | | | | |
| BCWP(cum) | | | | | | | | |
| ACWP | | | ACTUAL COST OF THE WORK PERFORMED | | | | | |
| ACWP(cum) | | | | | | | | |
| BCWS | 1200 | 1200 | BUDGETED COST OF THE WORK SCHEDULED | | | | | |
| BCWS(cum) | 1200 | 2400 | | | | | | |
| %COMPLETE | | | PROJECT % COMPLETE=BCWP/BAC | | | | | |
| CV | | | COST VARIANCE=BCWP-ACWP,>=0 DESIRED | | | | | |
| SV | | | SCHEDULE VARIANCE=BCWP-BCWS,>=0 DESIRED | | | | | |
| CPI | | | COST PERFORMANCE INDEX=BCWP/ACWP,>=1 DESIRED | | | | | |
| SPI | | | SCHEDULE PERFORMANCE INDEX=BCWP/BCWS,=>1 DESIRED | | | | | |
| | | | | | | | | |
| FORECAST | | | | | | | | |
| | WEEK 1 | WEEK 2 | | | | | | |
| ETC | | | ESTIMATE TO COMPLETE (BAC-BCWP)/CPI | | | | | |
| BAC | 7200 | 7200 | BUDGET AT COMPLETION | | | | | |
| EAC | | | FORECAST AT COMPLETION=BCWS+ETC | | | | | |
| VAC | | | VARIANCE AT COMPLETION=BAC-EAC | | | | | |
| | | | | | | | | |
| | | | | | | | | |
| RISK MANAGEMENT RESERVE | | | | | | | | |
| | WEEK 1 | WEEK 2 | | | | | | |
| RESERVE | | | | | | | | |
| NET RMR | | | VAC-RMR | | | | | |
| | | | | | | | | |

*FIG. 5*

FIG. 6A

| ORGANIZATIONAL | | WORK BREAKDOWN STRUCTURE | | | | | | | | | | | | | | | | | | | | | | | |
|---|---|---|---|---|---|---|---|---|---|---|---|---|---|---|---|---|---|---|---|---|---|---|---|---|---|
| BREAKDOWN | | | | | | | | | | | | | | | | | | | | | | | | | |
| STRUCTURE | | | | | | | | | | | | | | | | | | | | | | | | | |
| | | SUN | | | | | | | | | | | | | | | | | | | | | | | |
| | | 1 | | | | 2 | | | | 3 | | | | 4 | | | | | | | | | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 | | | | | | | | |
| | RED | 40 | 40 | 40 | 40 | | | | 40 | 40 | | | | | | 40 | | 280 | 7 | 30 | | | | | |
| ACME | GREEN | 40 | 40 | | | | | | | | | | | 40 | 40 | 40 | | 200 | 5 | 30 | | | | | |
| eDOT | BLUE | | 40 | | | 40 | 40 | 40 | | | 40 | 40 | 40 | | | | | 280 | 7 | 30 | | | | | |
| COMPANY | AQUA | | | 40 | | 40 | 40 | 40 | 40 | | | | | | 40 | | | 240 | 6 | 30 | | | | | |
| | MAGENTA | 40 | | | | | 40 | | | 40 | 40 | 40 | 40 | | | | 40 | 280 | 7 | 30 | | | | | |
| | ORANGE | | | | | | | 40 | | | | | | 40 | 40 | 40 | 40 | 200 | 5 | 30 | | | | | |
| | | 120 | 120 | 80 | 40 | 80 | 120 | 120 | 80 | 80 | 80 | 80 | 80 | 80 | 120 | 120 | 80 | 1480 | 37 | 180 | | | | | |
| | | 360 | | | | 400 | | | | 320 | | | | 400 | | | | 1480 | | | | | | | |
| | | STAR | | | | | | | | | | | | | | | | | | | | | | | |
| | | 1 | | | | 2 | | | | 3 | | | | 4 | | | | | | | | | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 | | | | | | | | |
| | RED | | | | | | 40 | | | 40 | 40 | 40 | 40 | | | | | 200 | 5 | | | | | | |
| ACME | GREEN | | | 40 | 40 | | | 40 | | 40 | | | | 40 | | | | 200 | 5 | | | | | | |
| eDOT | BLUE | 40 | 40 | 40 | 40 | | | | | | | | | | | 40 | | 200 | 5 | | | | | | |
| COMPANY | AQUA | 40 | 40 | 40 | | 40 | 40 | | | | | | | | | 40 | 40 | 280 | 7 | | | | | | |

TO FIG. 6B

FIG. 6B

FROM FIG. 6A

| | | | | | | | | | | | | | | | | | | | | | | | | | |
|---|---|---|---|---|---|---|---|---|---|---|---|---|---|---|---|---|---|---|---|---|---|---|---|---|---|
| | MAGENTA | | | | 40 | | | | 40 | | | 40 | 40 | | 40 | 40 | | 240 | 6 | | | | | | |
| | ORANGE | | | | | | 40 | 40 | 40 | 40 | | | | | 40 | 40 | 40 | 280 | 7 | | | | | | |
| | | 80 | 80 | 120 | 120 | 40 | 120 | 80 | 80 | 120 | 40 | 80 | 80 | 40 | 80 | 160 | 80 | 1400 | 35 | | | | | | |
| | | 400 | | | | 320 | | | | 320 | | | | 360 | | | | 1400 | | | | | | | |
| | | | | | | | | | | | | | | | | | | | | | | | | | |
| | | TRIANGLE | | | | | | | | | | | | | | | | | | | | | | | |
| | | 1 | | | | 2 | | | | 3 | | | | 4 | | | | | | | | | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 | | | | | | | | |
| | RED | | | | 40 | | 40 | | 40 | | | | | 40 | | | 40 | 200 | 5 | | | | | | |
| ACME | GREEN | 40 | 40 | | | | 40 | 40 | | | | | | 40 | 40 | 40 | 40 | 320 | 8 | | | | | | |
| eDOT | BLUE | 40 | 40 | | | | | | | 40 | 40 | 40 | 40 | | | | | 240 | 6 | | | | | | |
| COMPANY | AQUA | | 40 | 40 | | 40 | 40 | 40 | | | | | | | 40 | | | 240 | 6 | | | | | | |
| | MAGENTA | | | 40 | | | | | | 40 | | | 40 | 40 | | | 40 | 200 | 5 | | | | | | |
| | ORANGE | | | 40 | 40 | 40 | | | | | | | | | | 40 | | 160 | 4 | | | | | | |
| | | 80 | 120 | 120 | 80 | 80 | 120 | 80 | 40 | 80 | 40 | 40 | 80 | 120 | 80 | 80 | 120 | 1360 | 34 | | | | | | |
| | | 400 | | | | 320 | | | | 240 | | | | 400 | | | | 1360 | | | | | | | |
| | | | | | | | | | | | | | | | | | | | | | | | | | |
| | | CROSS | | | | | | | | | | | | | | | | | | | | | | | |
| | | 1 | | | | 2 | | | | 3 | | | | 4 | | | | | | | | | | | |

TO FIG. 6C

FROM FIG. 6B

| | | | | | | | | | | | | | | | | | | | |
|---|---|---|---|---|---|---|---|---|---|---|---|---|---|---|---|---|---|---|---|
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 | | |
| | RED | 40 | | | | 40 | 40 | 40 | 40 | | | | | 40 | 40 | 40 | 40 | 360 | 9 |
| ACME | GREEN | | | 40 | | 40 | | 40 | | | | | | | | 40 | 40 | 200 | 5 |
| eDOT | BLUE | | | | 40 | | 40 | | | 40 | 40 | 40 | | | | | | 200 | 5 |
| COMPANY | AQUA | | | 40 | 40 | 40 | | | | | | | 40 | 40 | | | | 200 | 5 |
| | MAGENTA | 40 | 40 | | | | | | | 40 | 40 | | 40 | 40 | | | | 240 | 6 |
| | ORANGE | | | | | 40 | 40 | 40 | 40 | | | 40 | 40 | 40 | | | | 280 | 7 |
| | | 80 | 40 | 80 | 80 | 160 | 120 | 120 | 80 | 80 | 80 | 80 | 120 | 160 | 40 | 80 | 80 | 1480 | 37 |
| | | 280 | | | | 480 | | | | 360 | | | | 360 | | | | 1480 | |
| | | | | | | | | | | | | | | | | | | | |
| | | DIAMOND | | | | | | | | | | | | | | | | | |
| | | 1 | | | | 2 | | | | 3 | | | | 4 | | | | | |
| | | 1.1 | 1.2 | 1.3 | 1.4 | 2.1 | 2.2 | 2.3 | 2.4 | 3.1 | 3.2 | 3.3 | 3.4 | 4.1 | 4.2 | 4.3 | 4.4 | | |
| | RED | | | | | | | | | 40 | 40 | 40 | 40 | | | | | 160 | 4 |
| ACME | GREEN | 40 | | | 40 | 40 | | | 40 | 40 | | | | 40 | 40 | | | 280 | 7 |
| eDOT | BLUE | | 40 | 40 | 40 | | | | | | 40 | | | | 40 | 40 | 40 | 280 | 7 |
| COMPANY | AQUA | 40 | 40 | | | | | 40 | 40 | 40 | 40 | | | | | | | 240 | 6 |
| | MAGENTA | | | 40 | 40 | 40 | 40 | | | | | | 40 | 40 | | | | 240 | 6 |
| | ORANGE | 40 | 40 | | | | | 40 | | | | 40 | 40 | 40 | 40 | | | 280 | 7 |
| | | 120 | 120 | 80 | 120 | 80 | 40 | 80 | 80 | 120 | 120 | 80 | 120 | 120 | 120 | 40 | 40 | 1480 | 37 |
| | | 440 | | | | 280 | | | | 440 | | | | 320 | | | | 1480 | |

FIG. 6C

SYSTEM AND METHOD FOR TEACHING PROJECT MANAGEMENT SKILLS

TECHNICAL FIELD OF THE INVENTION

This invention relates in general to the field of management and more particularly to a system and method for teaching project management skills.

BACKGROUND OF THE INVENTION

Effective project management is the key to completing any project successfully. Project management generally refers to the application of knowledge, skills, tools, and techniques to describe, organize, oversee, and control various project processes. Proper project management may involve developing and managing a suitable project plan, planning and defining an appropriate project scope, creating an adequate project schedule, and planning resources accordingly while simultaneously balancing budgetary constraints, quality control plans, quality assurance targets, organizational planning (including management of staff and resources), and risk controls.

Project management is considered successful when the needs of the client or of the stakeholders have been met or exceeded. A client or a stakeholder may be any person or organization to be positively or negatively effected by the project's execution. Project management, however, is growing increasingly more complex in today's society. In response to this growing complexity, the ability to educate persons about the fundamentals of project management and of sound decision making related to project management tasks has become increasingly difficult. Properly informing persons wishing to manage projects effectively is an arduous task in that there is a wealth of information that must be learned, much of which is extremely complicated, intricate in nature, and accordingly difficult to convey clearly to an audience. The highly active nature of project management, with a number of deliverables and activities generally happening or being executed concurrently, translates into the subject matter of project management being a difficult field of study in which to instruct.

SUMMARY OF THE INVENTION

From the foregoing, it may be appreciated by those skilled in the art that a need has arisen for an improved instruction capability for teaching project management skills. In accordance with one embodiment of the present invention, a project management game is provided that substantially eliminates or greatly reduces disadvantages and problems associated with conventional project management teaching techniques.

According to an embodiment of the present invention, a system for teaching project management skills is provided that includes a game board having indicia thereon. The indicia represents a plurality of tasks that collectively form a plurality of deliverables to be completed and to be managed by a plurality of participants in the project management game. The participants form one or more teams that play the project management game. A plurality of game pieces are positioned on the game board, wherein each of the game pieces represent a selected one of the teams. The project management game ends when one or more of the game pieces reach a project closedown portion of the game board. The game further includes a first die having a plurality of sides with numbers thereon. The first die may be rolled in order to indicate a number of spaces to be moved by a selected one of the game pieces. A second die is also included having a plurality of sides with numbers thereon. The second die may be rolled in order to indicate a cost value associated with one or more of the tasks.

Certain embodiments of the present invention may provide a number of technical advantages. For example, according to one embodiment of the present invention, an instruction approach is provided that allows project management to be taught to one or more persons in a game scenario environment. A project management game is provided that allows for the free flow of communications between participants in addressing concerns that are realized in typical project management scenarios. The collegial environment provided by the project management game also removes inhibition from participants in asking questions that may be inappropriate to ask in front of managers or clients in a real-world scenario. Embodiments of the present invention may enjoy some, all, or none of these advantages. Other technical advantages may be readily apparent to one skilled in the art from the following figures, description, and claims.

BRIEF DESCRIPTION OF THE DRAWINGS

To provide a more complete understanding of the present invention and features and advantages thereof, reference is made to the following description, taken in conjunction with the accompanying figures, wherein like reference numerals represent like parts, in which:

FIG. 4 is a block diagram of a project review work sheet to be completed while playing the project management game;

FIG. 5 is an earned value management system (EVMS) definitions chart to be reviewed by participants while playing the project management game;

FIGS. 6A, B, C is a work breakdown structure-organizational breakdown structure (WBS-OBS) chart to be referenced by participants while playing the project management game.

DETAILED DESCRIPTION OF THE INVENTION

Figure 1:
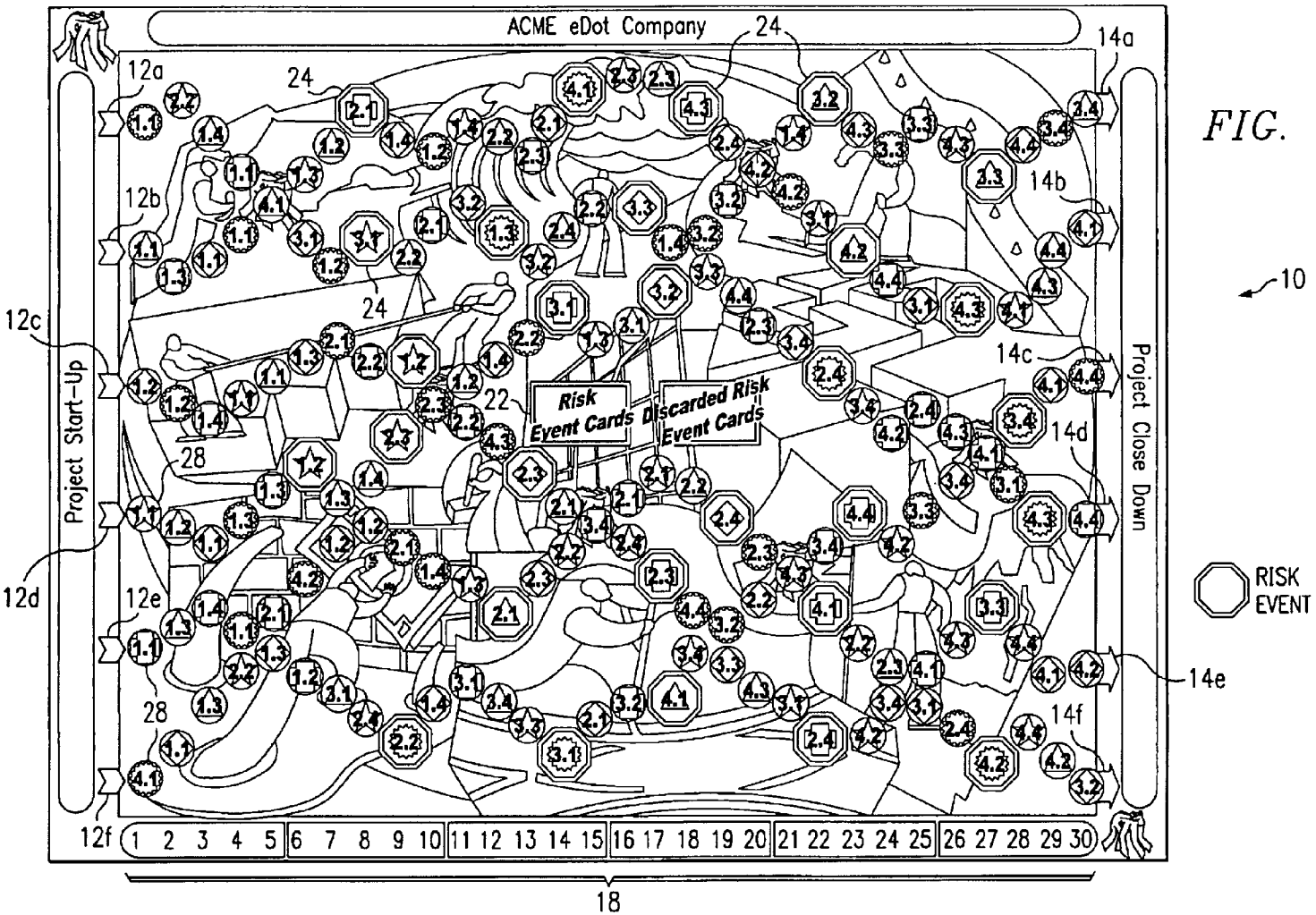
FIG. 1 is a simplified block diagram of a game board for playing a project management game in accordance with one embodiment of the present invention.

FIG. 1 is a simplified block diagram of a game board 10 to be used in a project management game for educating persons about the field of project management in accordance with one embodiment of the present invention. Game board 10 includes a series of starting points 12*a* through 12*f* within a project start-up section that receive one or more game pieces representing one or more participants in the project management game. Game board 10 also includes a series of finishing points 14*a* through 14*f* for the game pieces at a project close down section. The game pieces may be positioned at starting points 12*a* through 12*f* and moved across game board 10 while the project management game is played. Game board 10 also includes a timeline 18 that represents a thirty-day schedule (one task per day per team), the thirty days collectively representing the full planned duration of the project.

Game board 10 further includes a series of risk event cards 22 that may be drawn by participants of the project management game when a selected game piece lands on one of a plurality of risk event spaces 24. Game board 10 also includes a series of spaces 28 that represent a specific task or event to be completed while navigating through the project management game. Both the risk event spaces 24 and the task spaces 28 are described in greater detail below with reference to FIGS. 2 through 7.

According to the teachings of the present invention, a project management game is provided that educates project managers and associated personnel about the interrelationships of several project management tools using game board 10. The project management game integrates a series of project management fundamentals in order to teach project management principles in a realistic environment. The project management tools and components sought to be explored in playing the project management game include the scope of the project, the tasks associated with the project, the work breakdown structure, the organizational breakdown structure, the scheduling of the project, the budget and cost associated with the project, the risk management associated with the project, and the earned value associated with the project. These management tools are used in the practice of project management to effectively manage projects, report project status, make accurate forecasts, and generally meet or exceed project expectations of the client. Participants in the project management game are given game board currency, dice, and game pieces to move across game board 10. A designated participant plays the role of a coach and may effect a level of project risk or another associated parameter of the project management game as the game is being played by changing the dice and one variable in the rules. The project management game does not require an extensive knowledge of project management, only a willingness to learn and to explore project management fundamentals and techniques.

Referring again to FIG. 1, the coach of the project management game provides overall flow and control of the game as the participants navigate across game board 10. It may be appropriate in certain circumstances for the coach to be familiar with the game and the tools and processes that are used in project management in order to facilitate the development of the participants in the game as well as to explain the results of the game to the participants as the game is played. In addition, the coach may be used to facilitate a review at various stages of the project management game, answer any questions as the game is being played, or target issues to be discussed after completion of the game.

In a particular embodiment of the present invention, six to eight participants play the project management game. There may be six functional leaders, a project manager, and a chief financial officer. In the case where less than eight players are participating in the game, the coach or any other suitable person may play the role of chief financial officer or a functional leader may assume the role of project manager in certain circumstances. Alternatively, the participants may fill any of the assigned roles in any suitable fashion in order to facilitate game play.

In the case where there are several teams playing, a program manager may also be included in order to assist the teams in moving across game board 10 and to any one of finish points 14*a* through 14*f*. The program manager prepares a set of program review charts based on input from the projects and may assess total program status. The program manager may also manage the risk management reserve at the program level for the participating teams.

Each functional leader may lead a team identified by a color. Each functional leader is generally responsible for identifying and reporting progress to the project manager. The project manager is in turn responsible for controlling the play, executing the risk management, controlling the risk management reserve, and preparing the project review charts (as illustrated in FIG. 4) with assistance from the team. The chief financial officer distributes the budgets and collects the actual expenses from the functional leaders. The chief financial officer also deducts expenses from the risk management reserve and may support or provide guidance for the decision making of moves executed during game play.

Game board 10 represents a schedule that includes six paths for game piece movement. These paths may be varied, where appropriate, as the game is played. One path is designated for each functional leader and each path includes thirty tasks for a total of one hundred eighty tasks represented on game board 10. Each task may be budgeted at any suitable amount, such as for example forty dollars. Five tasks per team are scheduled for completion each week. Each path also includes risk event spaces 24 and a series of potential shared events.

Figures 2, 3A:
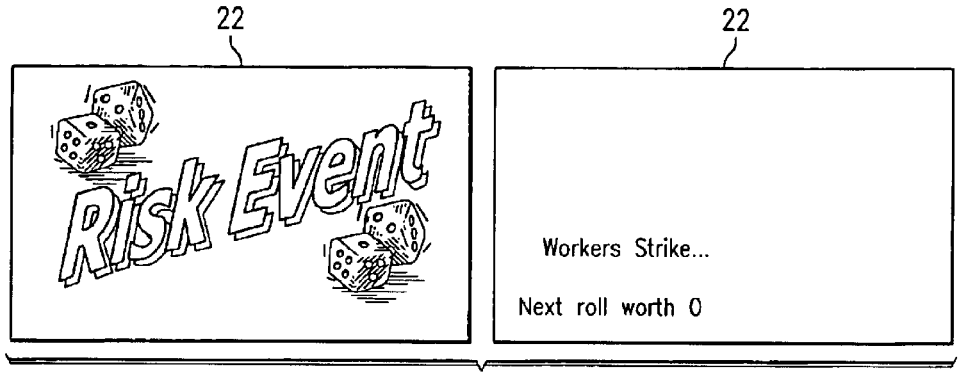
FIG. 2 is an illustration of a front side and a back side of a risk event card to be used in conjunction with the game board.
FIGS. 3A, B is a block diagram of a score sheet to be completed while playing the project management game.

The project management game includes several game pieces, one for each functional leader. The game set may also include six sets of dice, one set for each functional leader. A white-colored die may be used for indicating the number of spaces (tasks) and a green-colored die may be used for indicating the cost of each space or task. Two other sets of dice may also be utilized for purposes of effecting risk management and risk events. Risk event cards 22, as illustrated in FIG. 2, are provided to offer this feature of the project management game and include a described risk along with its potential impact.

Risk event cards 22 are provided to offer a real world scenario that either benefits or hinders a participant landing on risk event space 24. Risk event cards 22 generally provide for the occurrence of some event accompanied by an instruction to be followed by a selected participant. In the example provided in FIG. 2, a participant is informed of a worker's strike and instructed that the next roll of the die will be worth 0 spaces. Risk event cards 22 may offer any suitable instruction, including moving backward or forward on game board 10. The events on each of risk event cards 22 may reflect any influencing project management parameter, which operates to provide a real life event or occurrence potentially encountered by a person in the field of project management.

Each functional leader or project or program manager may receive a suitable amount of money or game board currency from the chief financial officer in order to complete a given project and to sufficiently fund the risk management reserve. In a particular embodiment of the present invention, each functional leader is given $1200 from the chief financial officer in order to complete the assigned project as the project management game is played. The project review charts and the earned value tools, as discussed in greater detail below with reference to FIGS. 4 through 7, may be used and referenced by the participants in playing the project management game.

The object of the project management game is to complete the project within the assigned budget and to maintain a risk management reserve of not more than five percent at the project closedown stage, i.e. finish points 14*a* through 14*f*, of the project management game. The project management game may be played in generally two parts, where part one estimates the size of a given set of budgets, including the risk management reserve budget, and part two begins play in executing the project to be completed.

During part one of the game, the amount of risk associated with the uncertainty in the project's duration for each task or tasks to be performed is estimated using game board 10, the dice, and the game pieces in a simple simulation. A budget may be established for estimating the risk associated with each project. The amount of risk associated with the shared events is estimated and a budget is established. Also in part one, the amount of risk associated with the unexpected events is estimated and a corresponding budget is established. Once these three budgets have been established, they may be combined in order to form the risk management reserve for each project. Approximately ten percent of each project's risk management reserve is allocated to the program level risk management reserve. Other ratios or percentages may be set depending upon assessment of the overall program risk or based on any other fact or parameter that may be used to influence the playing of the project management game.

Part two of the game includes the actual game flow as the participants may begin moving game pieces across game board 10. Play begins after roles have been assigned and the budgets, counters, and dice have been provided to the functional leaders. In addition, the risk management reserve data, the project review charts, and the earned value tools may be provided to the project manager. Risk event cards 22 may then be suitably placed on game board 10 and a red die may be provided on or alongside game board 10 for influencing and providing a risk management element to the game as it is played. The red die may be used by the coach, project manager, or program manager in order to increase or decrease risk associated with the completion of future tasks by the functional leaders. The red die provides the opportunity for simulated pressure and timing constraints in order to reflect realistic scenarios in a project management environment. The red die may be properly numbered and infused at any suitable time during game play.

Each of the game pieces may be positioned at respective starting points 12*a* through 12*f*. One of the participants may then roll the die to initiate playing of the game, the rolling of the die represents the passage of one week. Functional leaders roll the dice to determine the number and the cost of the tasks to be completed. Functional leaders may then pay the chief financial officer the appropriate amount of game board currency and move their corresponding game piece according to the die that was rolled. Landing on risk event space 24 requires a drawing of a selected one of risk event cards 22 and acting accordingly. Landing on a shared event space requires waiting for another participant to land on the same space before proceeding further. Functional leaders may assess their progress and mark off the tasks completed on the work breakdown structure-organizational breakdown structure (WBS-OBS) chart as illustrated in FIG. 6.

Each team, led by the project manager, may execute an earned value analysis and prepare project review charts based on the performance for a given period of time. An example of such a project review sheet is illustrated generally by FIG. 4. In addition, the earned value management system definitions may be provided by the block diagram illustrated in FIG. 5. Each functional leader may also prepare an earned value analysis of the tasks in each of their respective domains.

In the case of multiple teams playing the project management game, where several projects are being completed in an overall program, the program manager may prepare the overall program status based on input from each of the projects. The functional leaders may perform an earned value analysis for each respective team over the course of several projects. The project manager may use the risk management reserve to buy additional spaces (thereby completing additional tasks) and may reallocate budget parameters as required to move the team forward. In the case where multiple teams are playing as separate projects within an overall program, the program manager may reallocate risk management reserve as deemed appropriate. The above process of collectively rolling the dice, moving the game pieces, performing an earned value analysis, managing risk, and reporting progress is repeated until any one or all of the game pieces have reached the project closedown phase at finish points 14*a* through 14*f*.

After completion of the game, a review or discussion may then ensue that evaluates performance and that addresses concerns or questions posed by playing the project management game. In participating in the project management game, and in accordance with the teachings of the present invention, a series of project management skills may be developed and taught to employees or persons interested in the study of project management. In playing the project management game, program managers may begin to understand more clearly how to manage projects effectively and how to meet cost and schedule constraints (in a proactive fashion) as a result of the lessons reinforced in understanding the relationships between contract tasks, project scope, work breakdown structure, organizational breakdown structure, schedule, budget, cost, and risk management. In addition, program managers may use the earned value information provided by the project management game to accurately assess current program status and prepare accurate forecasts or outlooks in the programs or projects which they are completing. Program managers may also recognize more quickly the value of a suitable risk management reserve, appreciate its size, and correctly use it proactively to minimize the impact of risk events such as those posed by the teachings of the project management game.

Project managers may also benefit from the teachings of the present invention in more effectively understanding the concepts of tasks, scope, work breakdown structure, organizational breakdown structure, schedule, budget, cost, and risk management as described above. Project managers may further understand the overall structure of project management and why project status is presented first followed by more technical issues at project reviews. Other participants of the project management game should understand the importance of developing a team approach to managing and executing a project after playing the project management game. In addition, relationships may be formed and trust developed between the participants, such as project managers and program managers, as the game is being played. The project management game may operate to build team unity in displaying how the progress of individual participants, which is monitored and reported, affects team progress and team goals. The project management game may also demonstrate the importance of implementing risk management awareness early and often. This in turn may operate to improve client satisfaction resulting from increased efficiency in client expectations being met or exceeded.

Referring again to FIG. 1, game board 10 illustrates a project to be completed for the Acme eDot Company. The Acme eDot Company is provided only for purposes of teaching the present invention as the project management game may be implemented in any industry or area where projects are sought to be completed and where project management techniques may be implemented. In the example provided, Acme eDot Company develops, tests, and installs internet applications and supporting software. In addition, Acme eDot Company purchases, installs, and debugs supporting hardware. Finally, the Acme eDot Company integrates software and hardware with existing systems.

A scenario, a new contract which has been signed by its chief executive officer has been presented to the Acme eDot Company. The project, as illustrated on game board 10, must provide five high level tasks in approximately six weeks. The schedule, budget, and six teams have been established and, in this particular scenario, the schedule and budget are deemed "aggressive."

As a team, the objectives are to complete execution of the project, to control the project during its execution, and to reach the closedown phase as indicated on game board 10 while maintaining budgetary constraints and meeting or exceeding client expectations. Each of the teams may conduct a weekly project review for the client and for Acme's management. In first addressing the scope and the work breakdown structure, five high level deliverables are to be provided. The five high level deliverables are represented on game board 10 by the following symbols—sun, star, triangle, cross, and diamond. Each deliverable may be broken down further into additional levels. The client may only be concerned with the top two levels of the deliverable, where eighty deliverables represent the total amount to be completed. Each deliverable has one or more tasks performed by the functional teams, producing a result of one hundred eighty tasks. This configuration is shown generally by the WBS-OBS as illustrated in FIG. 6.

The organizational breakdown structure includes six functional teams represented by a series of colors, such as red, green, blue, aqua, magenta, and orange. Six functional teams are represented by six functional leaders, one per team. One project manager is also provided as well as one chief financial officer to oversee the finances during project completion.

Each of the functional leaders execute tasks, manage their assigned budget, and report their status to the project manager using the score sheet as illustrated in FIG. 3. The project manager collects weekly reports and consolidates information at the project level. The project manager also prepares project status, forecasts upcoming events based on project data, and presents such information and findings at a weekly project review meeting. The chief financial officer, as described above, distributes and collects the game board currency and may also operate to assist team members where appropriate. The organizational breakdown structure for each team is illustrated in FIG. 6.

For the Acme eDot Company example as provided in FIG. 1, a series of budgets have been effectively established. The project will be executed with only a salary allotment provided. No capital equipment or other expenses may be incurred. Forty dollars is required to complete each task and thirty tasks are to be completed by each team. Each functional leader may be given a budget to meet the salary requirements for all deliverables, e.g. $1200.

The schedule assumes a fifty percent probability of completing five or more tasks per week per team. The schedule also assumes that a six-week project will be executed and each team will complete thirty tasks before reaching the project closedown section of game board 10. Game board 10 effectively represents these elements of the schedule. Project startup is provided at starting points 12*a* through 12*f*, where a project closedown is illustrated by finishing points 14*a* through 14*f*. There are six colored tracks provided on game board 10, one per functional leader. In addition, game board 10 provides for thirty spaces per track where numbers and symbols are coordinated with the work breakdown structure as illustrated in FIG. 6. A project review may occur every five spaces or each week.

Risk event spaces 24 are marked as such and risk event cards 22 are drawn when participants land on spaces marked risk event. Shared events are bicolored spaces and count as two tasks, one for each team. Each team begins the project management game by estimating the risk management reserve for the Acme eDot Company. The risk management reserve should be enough to finish the project yet not more than five percent of the risk management reserve should be remaining at project close down. In addition, each team should assess the total risks for the Acme eDot Company. This includes an estimation of the risks associated with the duration of the tasks, the risks due to the shared events, and potential unexpected risks (knowns/unknowns). A process may be initiated where an assessment of risk is identified, the probability of completing the project on time is calculated, and a risk management reserve is established before initiating execution of the project.

In estimating the risk, several perspectives may be considered in determining the expected project duration. Completing five tasks per week is probably aggressive, where completing between four and five tasks a week is more likely based on the indicia of the die. In reality, the duration could be as low as three per week and as high as six based on rolls of the die. In attempting to estimate the risks, an estimation exercise may be performed. Function leaders may take a die and position their game pieces at the appropriate starting position. At the direction of the project manager, the functional leaders may roll the dice simultaneously and move the indicated spaces. Each roll again represents one week of elapsed time. It may be noted who falls behind and who moves ahead based on this estimation exercise. The project manager may then report out how many weeks, or rolls, that it took to complete the project and how many tasks were completed per week.

A Monte Carlo simulation may also be used in conjunction with the project management game and represents a mathematical model for computing the odds or probability of an outcome. In a Monte Carlo simulation, five tasks are planned per week where an optimistic performance is six tasks per week, a pessimistic performance is three tasks per week, and 4.5 tasks per week is most likely. In certain scenarios, the coach may dictate the number of tasks to be completed per week or vary such values during game play where appropriate.

For the Acme eDot Company, a shared event could be a specification review or a system test in the field of software technology. These examples offer typical considerations of project management where two or more functional organizations must execute a task concurrently. In addition, shared events similarly reflect real world scenarios where each team must occupy a selected space 28 for one roll before continuing. This may operate to restrict a team from achieving the full value of the die rolled.

Each functional leader, in participating in game play, may complete the following steps in sequence. At a first step, the dice is rolled representing one week's tasks. The chief financial officer may then be paid the actual cost of work performed (ACWP), which is equal to the white die roll times the green die roll times the number ten. A functional leader may then move the spaces shown on the white die, and draw a risk event card if required to do so. The square on the score sheet for each space (task) may then be highlighted and a status may then be provided to the project manager. The project manager controls the rolling of the die, consolidates project status, and prepares project review charts with the help/input of the team. The project manager may also present project status to executive committee members such as the coach or other team members where appropriate. The project manager and the team may then discuss how to proceed next in game play. These turns are repeated until each functional leader reaches project shutdown.

For each project manager, or for any other participant of the game, a series of reminders may be provided in the project review worksheet as illustrated in FIG. 4. These reminders may include current numbers reflecting the budgeted cost of work performed (BCWP), the actual cost of the work performed (ACWP), the budgeted cost of work scheduled (BCWS), the cost variance (CV), the schedule variance (SV), the cost performance index (CPI), the schedule performance index (SPI), the estimate to complete (ETC), the budget at completion (BAC), the estimate at completion (EAC), the variance at completion (VAC), a risk management reserve, and a net risk management reserve. Alternatively, these reminders could be any project management elements that inform participants of factors or values that should be considered during game play.

The BCWP value equals the white die value times forty. The ACWP per task equals the green die value times ten. The ACWP value equals the white die value times the green die value times ten. Project reviews may be provided at the end of each week and reflected on the block diagram of FIG. 4 and on the WBS-OBS of FIG. 6.

All forward motions by the game pieces are expenses payable to the chief financial officer. Backing up one or more spaces is generally not considered an expense and moving forward on spaces already earned requires additional expense for the moving team. In this sense, the task is not being earned again but something has to be done over which again reflects a real-world scenario. Waiting on shared events for a partner is not an expense to be incurred by the team. In addition, project roles may be rotated after each project review or at any other suitable time in order to stimulate learning or force participants into diverse roles.

Game pieces may be moved forward without rolling the die at the cost of fifty dollars per space. In the case of Acme eDot Company, this may be thought of as overtime but nonetheless necessary in order to complete a desired set of tasks or to provide the appropriate deliverables. The project manager may determine, with input from other participants, that such deliverable or task spaces 28 should be purchased. The project manager pays the appropriate sum of money to the functional leader, who in turn pays the chief financial officer, and then the game piece is moved the authorized spaces. The project manager may also buy a die with a higher expected value and assign that die to a functional leader. In this sense, a series of parameters may be controlled or bought in accordance with the teachings of the present invention. The project manager may also reallocate budgets between the teams after calculating risk management reserve on a weekly basis as part of the project review.

After reaching various stages in the project, project reviews may be conducted in order to target and to discuss project management principles. During the project review, a series of questions may be answered. First, what is the overall status of the project? As a second issue, what tasks have been completed and what tasks are ahead of schedule or behind schedule? Third, what functional group is ahead of or behind the others and why? At various points during the project management game it may be appropriate to stop the game play and discuss these elements and how these elements have been influenced or otherwise impacted by factors relating to project management. In addition, during the project review, a fourth question may be answered that relates to the forecast at completion, i.e. completion date, final cost associated with the project, sufficient risk management reserve, and possible improvement of the current situation. In addition, charts and histograms may be used during the project review to illustrate issues of concern to the team members.

Figure 7:
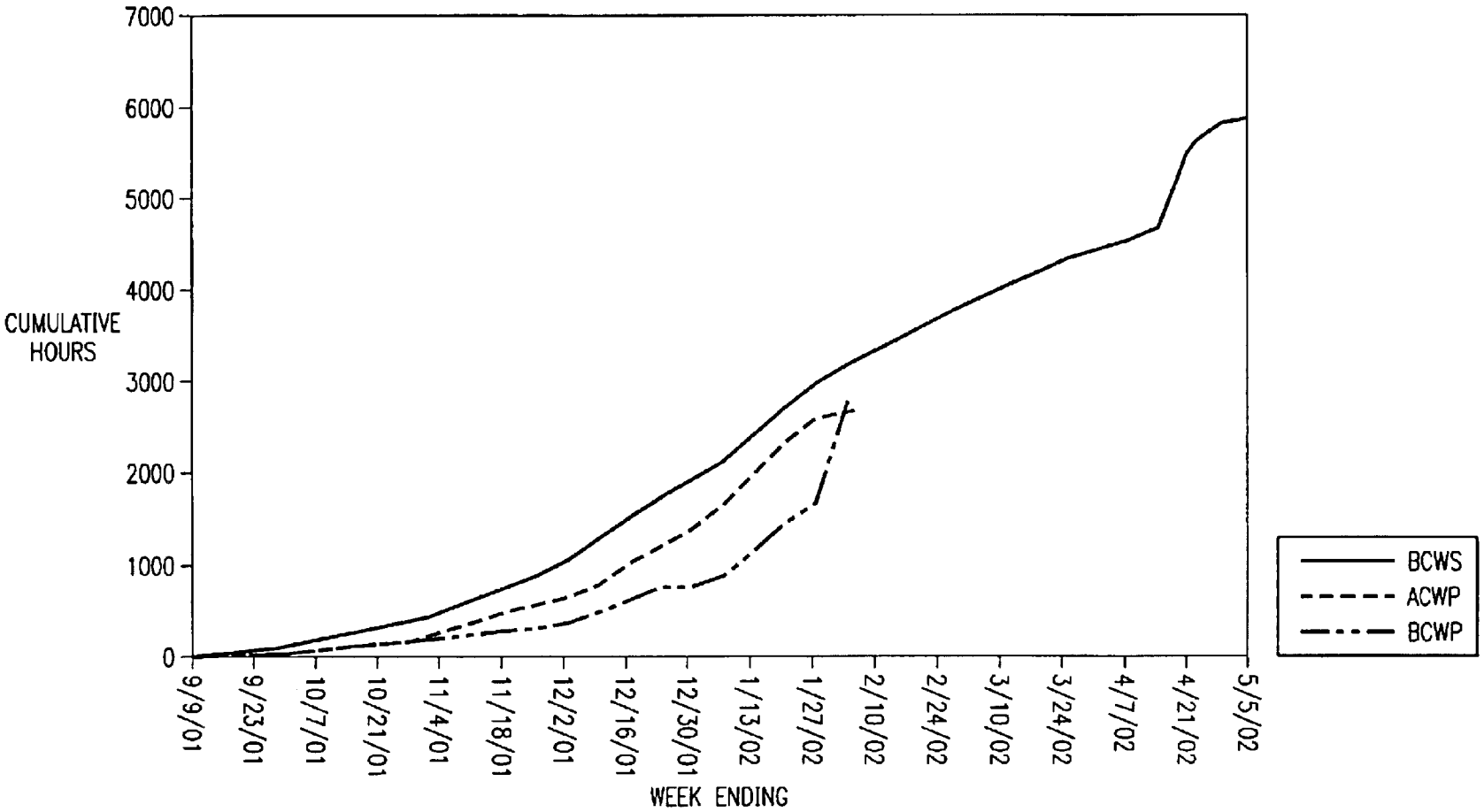
FIG. 7 is a graphical diagram illustrating a plurality of project management parameter trends, which reflect aspects of a project as it is executed.

The project review may also provide a forum in which to use tools and charts such as the trend chart illustrated in FIG. 7. FIG. 7 may provide BCWS, ACWP, and BCWP parameters reflecting trends in completion, execution, performance, and finance parameters associated with the project being executed. This data may offer comparisons from week to week, the status of the risk management reserve, and other suitable factors, such as those financial parameters illustrated in FIG. 4.

Once finish points 14*a* through 14*f* have been reached, reflecting project closedown for each team, a final review session or post mortem may be conducted in order to facilitate the discussion of the project management lessons learned. Items such as schedule slips, cost overruns, and variances and project management parameters may be addressed. In addition, risk management reserve elements may be reviewed in assessing how too much risk management reserve jeopardizes other projects, while too little risk management reserve jeopardizes the current project. In theory, the risk management reserve should be revisited periodically and adjusted accordingly. The risk management reserve represents a fundamental principle of project management to be understood in its fullest terms by participants of the project management game.

The project management game, as described above, may be used in a host of business environments in which project management techniques may be implemented. The Acme eDot Company represents just one example where project management is critical. Any other industry or business may benefit from the use of the present invention in educating persons about effective project management techniques.

Although the present invention has been described in detail with reference to particular embodiments, it should be understood that various other changes, substitutions, and alterations may be made hereto without departing from the spirit and scope of the present invention. For example, although the present invention has been described with reference to game board 10, the present invention may be used in computer applications where software is used in playing the project management game. In such an embodiment, correspondence between players may be via electronic mail or provided via a website or server that operates to facilitate game play through remote locations.

Additionally, although the present invention has been described with reference to specific dice, roles, designated currency values, and a particular game board 10, these elements may be varied considerably without departing from the teachings of the present invention. Such modifications may be made during game play or prior to initiation of game play where appropriate. In addition, numerous other parameters and features may be infused into game play in order to enhance the amusement of the project management game or to increase awareness and teaching of project management principles.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims. Also, in describing an embodiment of the present invention, any statement in the specification is not intended to limit the present invention in any way that is not otherwise reflected in the appended claims.

What is claimed is:

1. A project management game, comprising:

a game board having indicia thereon, the indicia representing a plurality of tasks that collectively form a plurality of deliverables to be completed and to be managed by a plurality of participants in the project management game, wherein the participants form one or more teams that play the project management game;

a plurality of game pieces positioned on the game board, each of the game pieces representing a selected one of the teams, wherein the project management game ends when one or more of the game pieces reach a project closedown portion of the game board;

a first die having a plurality of sides with numbers thereon, wherein the first die may be rolled in order to indicate a number of spaces to be moved by a selected one of the game pieces;

a second die having a plurality of sides with numbers thereon, wherein the second die may be rolled in order to indicate a cost value associated with one or more of the tasks, wherein a selected one of the participants plays the role of a coach operable to control a selected one of a set of risk, budgetary, and game piece movement parameters associated with the project management game;

a bank that includes game board currency, the bank being monitored by the chief financial officer, wherein the chief financial officer provides a designated sum of game board currency to each of the teams and collects a portion of the game board currency from each of the teams based on movement of the respective game piece by each of the teams;

a third die, the third die being controlled by the coach and incorporated into game play in order to dictate a selected project management game parameter chosen by the coach;

wherein the participants play roles of six functional leaders, a project manager, and a chief financial officer while playing the project management game, the functional leaders each representing a team that navigates through a plurality of the tasks represented on the game board, the project manager executing a plurality of reviews at selected stages of the project management game, the chief financial officer operable to dictate financial parameters to the participants for the tasks.

2. The project management game of claim 1, further comprising a risk management reserve fund, the risk management reserve fund comprising a portion of the game board currency, wherein the risk management reserve fund is controlled by the project manager, the risk management reserve fund being used to gain a financial advantage in completing the tasks of the project management game.

3. The project management game of claim 1, further comprising one or more project review charts and one or more earned value tools, wherein the project review charts and the earned value tools may be reviewed by the participants while playing the project management game.

4. The project management game of claim 1, wherein the game board includes a timeline that represents a plurality of days associated with the completion of one or more of the tasks.

5. The project management game of claim 1, wherein a selected one or the participants plays a role of a program manager, the program manager coordinating one or more projects being completed by one or more teams, wherein the program manager allocates game board currency during game play to one or more of the teams.

6. The project management game of claim 1, wherein one or more of the participants prepare one or more budgets associated with a project to be completed before initiating play of the project management game, wherein the budgets reflect a selected one or more of a set of unexpected events, a set of shared events, and a set of time parameters associated with the tasks.

7. The project management game of claim 1, wherein one or more of the participants prepare a risk management reserve budget associated with a project to be completed before initiating play of the project management game, wherein the risk management reserve budget represents a fund to be used by the teams as the project management game is played.

8. The project management game of claim 1, wherein the game board is software embodied in a computer readable media.

9. The project management game of claim 1, wherein the participants play the project management game by inputting commands into a computer coupled to a network.

10. The project management game of claim 1, further comprising a plurality of cards, wherein each of the cards include a risk event element thereon that informs a selected participant of a parameter associated with a selected one of the events.

11. The project management game of claim 10, wherein a selected one of the participants moves a selected game piece and responds to an instruction provided on a selected one of the cards.

12. The project management game of claim 11, wherein the indicia forms a plurality of pathways on the game board that guide each of the teams during game play, the pathways comprising a plurality of spaces operable to receive the game pieces, and wherein at least some of the spaces are color-coded and include a symbol, the symbol representing a selected one of the tasks.

13. The project management game of claim 12, wherein the pathways each include a risk event space that signals to a selected one of the participants to draw one of the plurality of cards, and wherein the risk event space also indicates that a selected one of the participants must wait for the arrival of another one of the participants on the risk event space before proceeding further on the game board.

* * * * *